US010306943B2

(12) United States Patent
Walterspiel

(10) Patent No.: US 10,306,943 B2
(45) Date of Patent: Jun. 4, 2019

(54) SHOCK ABSORBING SYSTEM

(71) Applicant: Juan N. Walterspiel, Menlo Park, CA (US)

(72) Inventor: Juan N. Walterspiel, Menlo Park, CA (US)

(73) Assignee: Juan N. Walterspiel, Menlo Park, CA (US)

( * ) Notice: Subject to any disclaimer, the term of this patent is extended or adjusted under 35 U.S.C. 154(b) by 98 days.

(21) Appl. No.: 15/586,931

(22) Filed: May 4, 2017

(65) Prior Publication Data

US 2017/0318891 A1 Nov. 9, 2017

Related U.S. Application Data

(60) Provisional application No. 62/332,799, filed on May 6, 2016, provisional application No. 62/334,065, filed on May 10, 2016.

(51) Int. Cl.

| | |
|---|---|
| ***A42B 3/06*** | (2006.01) |
| ***A42B 3/12*** | (2006.01) |
| ***A42B 3/28*** | (2006.01) |

(52) U.S. Cl.

CPC ..... *A42B 3/125* (2013.01); *A42B 3/063* (2013.01); *A42B 3/064* (2013.01); *A42B 3/121* (2013.01); *A42B 3/283* (2013.01)

(58) Field of Classification Search

CPC ..... A42B 3/121; A42B 3/125; A42B 3/064; A42B 3/063; A42B 3/283; A41D 13/015; B32B 2437/04

USPC ..... 428/34.1; 2/6.6, 6.8, 411–414, 425

See application file for complete search history.

(56) References Cited

U.S. PATENT DOCUMENTS

| | | | | |
|---|---|---|---|---|
| 4,012,794 | A | 3/1977 | Nomiyama | |
| 5,794,275 | A | 8/1998 | Donzis | |
| 8,566,968 | B2 * | 10/2013 | Marzec | A42B 3/12 2/411 |
| 9,289,021 | B2 * | 3/2016 | Kwan | A41D 13/015 |
| 9,332,799 | B1 * | 5/2016 | Wenner | A42B 3/064 |

(Continued)

FOREIGN PATENT DOCUMENTS

WO 2016209740 12/2016

OTHER PUBLICATIONS

International Search Report and Written Opinion for PCT/US2017/031113, dated Oct. 23, 2017, 18 pages.

(Continued)

*Primary Examiner* — Katherine M Moran

(74) *Attorney, Agent, or Firm* — Merchant & Gould P.C.

(57) ABSTRACT

A shock absorbing helmet includes an outer shell, an inner shock absorbing liner attached to the outer shell, and multiple compressible balls coupled with the outer shell and/or the shock absorbing liner in such a way that the compressible balls are free to move, relative to the outer shell and the shock absorbing liner, when the helmet is impacted by an object. A method of manufacturing a shock absorbing helmet involves forming an outer shell of the helmet, forming a shock absorbing liner of the helmet, attaching multiple compressible balls to the outer shell and/or the shock absorbing liner in such a way that the compressible balls are free to move, relative to the outer shell and the shock absorbing liner, when the helmet is impacted by an object, and attaching the outer shell to the shock absorbing liner.

24 Claims, 10 Drawing Sheets

(56) References Cited

U.S. PATENT DOCUMENTS

| | | | | |
|---|---|---|---|---|
| 9,756,891 | B1 * | 9/2017 | McGhie | A42B 3/121 |
| 2006/0059606 | A1 * | 3/2006 | Ferrara | A01N 25/18 2/412 |
| 2014/0109299 | A1 | 4/2014 | Kwan et al. | |
| 2016/0120256 | A1 | 5/2016 | Golnaraghi et al. | |
| 2018/0049504 | A1 * | 2/2018 | Markison | A41D 1/04 |

OTHER PUBLICATIONS

Partial International Search Report for PCT/US2017/031113, dated Aug. 29, 2017, 9 pages.

* cited by examiner

SHOCK ABSORBING SYSTEM

CROSS-REFERENCE TO RELATED APPLICATIONS

This application claims the benefit of U.S. Provisional Patent Application No. 62/332,799, filed May 6, 2016, and 62/334,065, filed May 10, 2016, both of which are entitled "Shock Absorbing System," and both of which are hereby incorporated by reference in their entireties into the present application.

TECHNICAL FIELD

This application relates generally to shock absorbing devices, systems and methods. More specifically, this application relates to shock absorbing devices, systems and methods for use in helmets and for padding structures to help prevent or minimize injury and/or structural damage caused by collisions.

BACKGROUND

Approximately 1.7 million adults and children suffer a traumatic brain injury (TBI) each year in the United States. Of these, approximately 137 million are treated and released from an emergency department, 275,000 are hospitalized, and 52,000 die. Motor vehicle crashes (including motorcycle crashes) account for about 17 percent of these TBIs. Motorcycle crashes account for approximately 10 percent of all motor vehicle crash fatalities, even though motorcycles make up only 3 percent of all registered vehicles in the United States. Per mile traveled, motorcycle crashes are approximately 37 times more lethal than automobile crashes. Although sports injuries contribute to fatalities infrequently, the leading cause of death from sports-related injuries is traumatic brain injury. Sports and recreational activities contribute to about 21 percent of all traumatic brain injuries among American children and adolescents. There were an estimated 446,788 sports-related head injuries treated at U.S. hospital emergency rooms in 2009. The most prevalent sports in which traumatic brain injury occurs are, in order of prevalence, cycling, football, and baseball/softball.

A variety of protective helmets have been developed to protect a user against injury resulting from an impact to the head. For example, in the sports of football, hockey, and baseball, players typically don helmets during play to protect their head from catastrophic injury, which may result from an impact by another player, impact with the ground, ice or side of a hockey rink, impact of a baseball pitch hitting the head, or the like. Helmets typically include a rigid outer shell formed of hard plastic and interior padding of various forms, including specially designed multiple studs in football helmets, formed of vinyl, foam, polypropylene, or similar material that is suited to absorb energy mechanically by being compressed and/or bending.

Conventional helmets for motorcycle riding, sports and other activities have been shown to effectively protect against some injuries, such as skull fractures, but are significantly less effective at protecting against other types of TBI and chronic traumatic encephalopathy (CTE). For example, while conventional helmets often work well at dampening linear forces caused by impacts towards the center of the head, they typically do not adequately dampen angular accelerations—or "glancing blows"—to the head, which force the brain to rotate within the skull. These angular impacts can be just as damaging to the different parts of the brain and brainstem as direct impacts.

Therefore, it would be highly advantageous to have improved helmets for use in motorcycle and bicycle riding, sports, transportation, the military, and any other human endeavors where TBI and CTE is a concern. Ideally, such helmets would include improved shock absorption capabilities, which would help prevent or at least reduce TBI and CTE caused not only by direct impacts, but also by angular impacts, regardless of the direction from which they come from. Also ideally, such helmets would be low-weight, light, inexpensive, washable, and practical to wear. At least some of these objectives will be addressed by the embodiments described below.

BRIEF SUMMARY

Generally, the present disclosure is directed to a shock absorbing system that includes multiple, compressible balls, which serve to absorb at least some of the force of an impact by compressing and/or moving, relative to one another and to a structure to which they are attached. The balls are described in this disclosure for two primary types of uses, although the disclosure should not be interpreted as being limited to those two uses. One use for the shock absorbing system is for helmets (or hats, caps, headbands or any other head gear for which shock absorption might be advantageous). Another use described herein is for external padding on any of a number of larger structures, one general category of which is sports structures, such as goal posts, sideline markers, or any other solid structure into which an athlete may impact. The description below focuses on helmet embodiments, but this is done for exemplary purposes only and should in no way be seen as limiting the applications for which the shock absorbing system may be used.

The compressible balls included in the embodiments described below may be of any suitable size, shape, material or combination thereof. In some embodiments, each ball is simply a shell, which may or may not have multiple holes in it (or "apertures" or "openings" or other similar terms, all of which may be used interchangeably herein). In some embodiments, each ball may include a shell and a substance within the shell, such as a fluid or gel. In some embodiments, all the compressible balls are free floating, such as within a cavity formed by two layers of a helmet. Alternatively, in other embodiments, some or all of the balls may be attached to one another, to one or more layers of the helmet, or both.

In one aspect of the present disclosure, a shock absorbing helmet may include, an outer shell, an inner shock absorbing liner attached to the outer shell, and multiple compressible balls coupled with the outer shell and/or the shock absorbing liner in such a way that the compressible balls are free to move, relative to the outer shell and the shock absorbing liner, when the helmet is impacted by an object. In some embodiments, the outer shell and the shock absorbing liner are attached in such a way as to form a cavity between them, and the multiple compressible balls are disposed in the cavity between the outer shell and the shock absorbing liner, such that they are free to roll within the cavity. In one embodiment, the multiple compressible balls are disposed in two within the cavity—an upper layer of compressible balls that contact the outer shell and a lower layer of compressible balls that contact the shock absorbing liner. In some embodiment, at least some of the compressible balls are free to move from the upper layer to the lower layer or from the lower layer to the upper layer upon impact of the helmet with the object. An alternative embodiment may include a middle shell disposed between the outer shell and the shock absorbing liner, where the upper layer compressible balls is disposed between the outer shell and the middle shell, and the lower layer of compressible balls is disposed between the lower shell and the middle shell.

In some embodiments, each of the compressible balls is hollow. In some embodiments, each of the compressible balls comprises multiple holes, and each of the multiple holes has a shape, such as but not limited to circular, oval or hexagonal. In various embodiments, the compressible balls may be made of a material such as but not limited to elastic materials, resilient materials or shape memory materials. In some embodiments, the multiple holes in each of the compressible balls are covered by the material, and the material covering the holes is thinner than the material forming the non-hole portion of the ball. In some embodiments, each of the compressible balls is filled with a substance such as but not limited to a liquid, a gel and a foam.

Some embodiments may further include at least one attachment member for attaching at least one of the multiple compressible balls the shock absorbing liner, the outer shell and/or a neighboring one of the multiple compressible balls. Examples of attachment members include but are not limited to flexible string, hook-and-loop fasteners, stretchable material, tear-away material, magnets, push-buttons, flexible collars and detachable adhesive.

In some embodiments, the helmet may include multiple holes extending through the outer shell and the shock absorbing liner, and one of the multiple compressible balls is disposed in each of the multiple holes such that each of the compressible balls protrudes through an inner surface of the shock absorbing liner and through an outer surface of the outer shell. Such an embodiment may also include multiple attachment members for attaching the multiple compressible balls the outer shell and/or the shock absorbing liner, to maintain the compressible balls in their locations within the multiple holes. Examples of such attachment members include but are not limited to hook-and-loop fasteners, magnets, push-buttons, flexible collars, pop-in/pop-out sleeves and detachable adhesive. In one embodiment, the multiple attachment members include a frame with multiple holes and multiple pop-in/pop-out sleeves attached to the frame around the multiple holes.

In another aspect of the disclosure, a method of manufacturing a shock absorbing helmet may include forming an outer shell of the helmet, forming a shock absorbing liner of the helmet, attaching multiple compressible balls to the outer shell and/or the shock absorbing liner in such a way that the compressible balls are free to move, relative to the outer shell and the shock absorbing liner, when the helmet is impacted by an object, and attaching the outer shell to the shock absorbing liner. In some embodiments, the outer shell and the shock absorbing liner form a cavity between them when they are attached to one another, attaching the multiple compressible balls involves placing the compressible balls in the cavity, and the multiple compressible balls are free to roll in the cavity upon impact of the outer shell with the object. In some embodiments, the compressible balls are placed between the outer shell and the shock absorbing liner before the outer shell and the shock absorbing liner are attached to one another to form the cavity. Optionally, the method may involve stacking an upper layer of the compressible balls over a lower layer of the compressible balls within the cavity between the outer shell and the shock absorbing liner of the helmet. Such a method may further involve positioning a middle shell of the helmet between the upper layer and the lower layer of the compressible balls.

In some embodiments, each of the compressible balls is hollow. In some of the embodiments, each of the compressible balls includes multiple holes. In some embodiments, the compressible balls are made of a material such as but not limited to elastic materials, resilient materials or shape memory materials. In some embodiments, each of the compressible balls is filled with a substance such as but not limited to liquids, gels or foams. In various embodiments, any suitable type and number of attachment members may be used for attaching the compressible balls, such as but not limited to flexible string, Velcro, stretchable material, tear-away material, magnets, push-buttons, flexible collars or adhesive. In some embodiments, some or all of the balls may be attached to one another using one or more attachment members. In some embodiments, the helmet may include multiple holes extending through the outer shell and the shock absorbing liner, and attaching the multiple compressible balls involves attaching one of the compressible balls within each of the holes.

In another aspect of the present disclosure, a structural padding system for reducing damage to an object caused by impacting a structure may include multiple compressible balls configured to at least partially compress when impacted and an attachment member for attaching the multiple compressible balls to the structure. The multiple compressible balls are coupled to the attachment member such that they are free to roll or otherwise move in at least one direction, relative to the attachment member, when the compressible balls are impacted by the object. Some embodiments of the system may also include a covering disposed over the multiple compressible balls, such as but not limited to a meshwork fabric, a flexible membrane, a hard material, a plastic, a solid fabric, an elastic material or a shape memory material. Any suitable structure may be covered, in full or in part, by the system. For example, the structure may be a post on an athletic field, a field sideline marker, a roadside pole, a tower, a roadside sign, a guardrail, construction equipment, stacked materials, snow or ice machines, a ski lift pole, an electric pole, a vehicle, a tree or the like.

These and other aspects and embodiments are described in more detail below, with reference to the attached drawing figures.

DETAILED DESCRIPTION

This disclosure relates generally to shock absorbing systems and methods for protecting against traumatic brain injury (TBI) and chronic traumatic encephalopathy (CTE) and/or other physical injury. The shock absorbing systems may be employed inside (and/or outside) of helmets and caps, athletic padding, structural padding and other suitable devices and structures.

Figure 1:
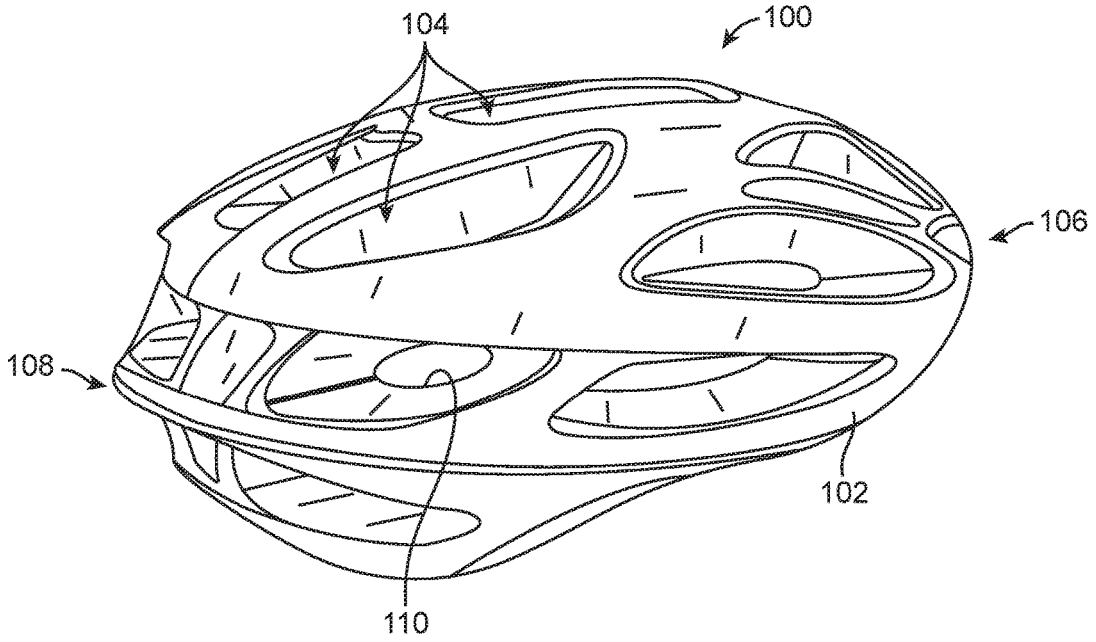
FIG. 1 is perspective view of a shock absorbing helmet, according to one embodiment.

FIG. 1 is a perspective view of a shock absorbing helmet 100, according to one embodiment. In FIG. 1, the shock absorbing system described in later figures is not visible, because the compressible balls of the system are enclosed within an inner cavity of the helmet 100. The helmet 100 has an anterior end 106 that fits over a wearer's forehead and a posterior end 108 that fits over the back of the wearer's head. The helmet 100 includes an outer shell 102 and an inner shock absorbing liner 110 (or "inner layer") for contacting the wearer's head. The outer shell 102 can be made of plastic, metal, leather, synthetic fibers, or any other suitable material or combination thereof. In this embodiment, the helmet 100 includes multiple openings 104, which may be advantageous for ventilation and aesthetic or fashionable appearance. Other embodiments, however, may not include openings 104, for example in motorcycle and football helmets. The helmet 100 shown in FIG. 1 is exemplary, and other suitable configurations are encompassed by this disclosure.

In many embodiments, the outer shell 102 may be made of any of a number of hard plastics, and the shock absorbing liner 110 may be made of a padding material, which may be relative hard or relatively soft in alternative embodiments. Any suitable materials may be used for the outer shell 102 and the shock absorbing liner 110, such as but not limited to materials used in currently available helmets for various purposes. The helmet 100 shown in FIG. 1, for example, has an outer shell 102 and a shock absorbing liner 112 that are typical for a cycling helmet. The outer shell 102 and shock absorbing liner 112 may also be attached to one another via any suitable method, such as by an adhesive and/or by one or more mechanical attachment features.

In general, two different categories of embodiments for shock absorbing helmets are described below, also many different variations within those categories are possible, and this disclosure is not limited to the two categories in any way. In the first category, the outer shell 102 and the shock absorbing liner 110 are attached together to form one or more inner cavities between the two layers, inside of the helmet 100, and multiple compressible balls are disposed inside the cavity or cavities. In the second category, the outer shell 102 and the shock absorbing liner 110 are attached together and shaped in such a way as to form multiple holes or openings in the helmet, and a compressible ball is held in each of the holes and acts to absorb shock upon impact. The embodiment the helmet 100 of FIG. 1 falls into the first general category. Although this helmet 100 does have openings 104, the compressible balls in this embodiment are not held in the openings 104 but instead are held inside an inner cavity between the outer shell 102 and the shock absorbing liner 110. A third general category of helmets is a hybrid category, which includes both compressible balls in an inner cavity and also compressible balls extending through holes in the helmet. Again, this disclosure is not limited to any of these three categories, but these are provided for explanatory purposes only. FIGS. 2A-3B generally describe helmet embodiments of the first category, FIGS. 4A-4E describe different types of compressible balls, and FIGS. 5-7B describe helmet embodiments of the second category.

Referring to FIGS. 2A-2D, various mechanisms for absorbing shock in a helmet 100 or alternatively a cap, hat, other headgear or other structure are illustrated, where each embodiment includes multiple, shock absorbing balls or spheres. Although the following description often focuses on the embodiment of the helmet 100, any of the compressible ball embodiments and shock absorbing system features may be applied to other types of headgear and/or other types of shock absorbing structures, and the description of the helmet embodiment should not be interpreted as limiting the scope of this disclosure. Some of the figures are cross-sectional views of portions of shock absorbing helmets 100, while other figures (FIGS. 2E and 2F) simply illustrate compressible balls with connecting structures, which may be used in helmets and other structures.

Figure 2A:
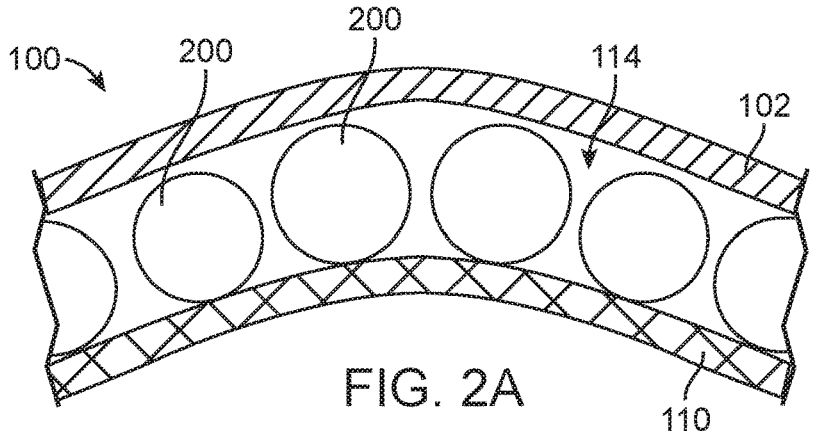
FIG. 2A is a cross-sectional side view of a wall of a shock absorbing helmet, according to one embodiment.
Figure 2B:
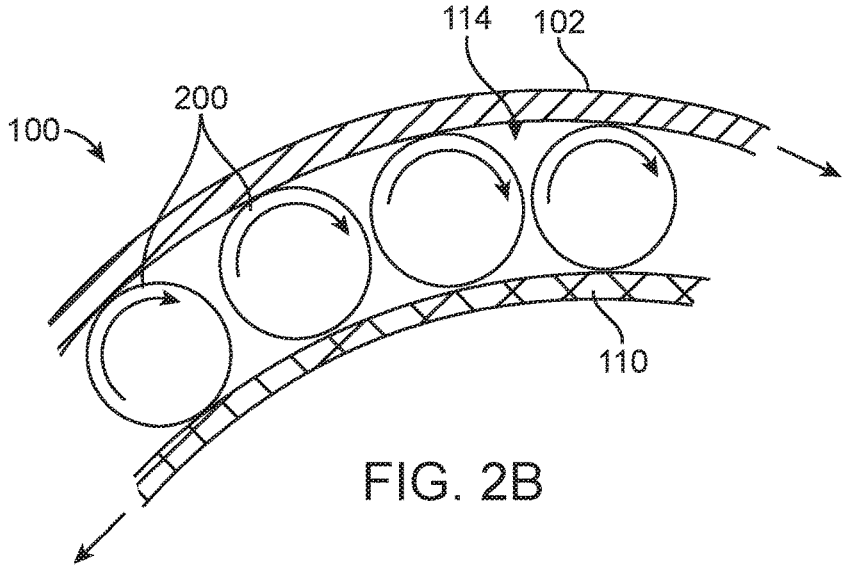
FIG. 2B is a cross-sectional side view of a wall of the shock absorbing helmet of FIG. 2A, showing movement dynamics of the system after a lateral impact.

In the embodiment of FIGS. 2A and 2B, a shock absorbing system for use in the helmet 100 may include multiple compressible/deformable hollow balls or spheres 200 (referred to herein generally as "compressible balls"), disposed in unconnected fashion within a cavity 114 between the outer shell 102 and the shock absorbing liner 110. The compressible balls 200 are configured to deform and roll within the cavity 114, and their compressibility and their ability to move within the cavity 114 allow them to absorb energy and thus dampen and disperse linear and angular forces, independently of the angle of impact. For example, when the helmet 100 experiences an impact, the impact kinetic energy is transferred, dampened and dispersed by the compressible balls 200 as they deform and roll. The compressible balls 200 may be made of substantially elastic and/or resilient material and may include openings and/or reinforcements that influence their deformation characteristics to dampen and disperse the impact forces regardless of the direction they come from.

FIGS. 2A and 2B show an embodiment in which the compressible balls 200 are not attached to one another and are not attached to the inner surfaces of the outer shell 102 or the shock absorbing liner 110. FIG. 2A shows the compressible balls 200 in stationary positions. FIG. 2B shows the same balls rolling within the cavity 114 (solid-tipped arrows within the balls 200), to illustrate the movement dynamics of the system after a lateral impact. In this embodiment, the compressible balls 200 are free to roll within the cavity 114 about all axes of rotation. In other embodiments, the compressible balls 200 may be attached to the outer shell 102, the shock absorbing liner 110, rims of the outer shell 102 or the shock absorbing liner 110 and/or one or more neighboring compressible balls 200. In any such embodiment where some or all of the compressible balls 200 are attached to one another or to a structure of the helmet 100, they may be attached in such a way that the attachment mechanism(s) flex, stretch, loosen or break when the helmet 100 undergoes an impact. In some embodiments, the attachment mechanism(s) may be reattached after such an impact, to restore the helmet 100 to its pre-impact configuration. Suitable attachment mechanism(s) may include, but are not limited to, flexible string, a hard or soft detachable adhesive, hook-and-loop fasteners (e.g., Velcro), tear-away fabric, magnets, push-buttons, flexible collars or the like. (This list will not be repeated for every embodiment below, but any suitable fastener or attachment mechanism may be used in any of the embodiments described.)

Figure 2C:
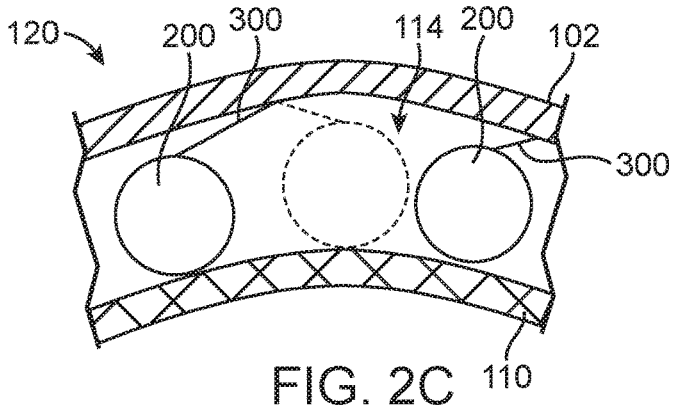
FIG. 2C is a cross-sectional side view of a wall a shock absorbing helmet, in which the compressible balls are attached to the outer shell by a flexible string, according to an alternative embodiment.

With reference now to FIG. 2C, in an alternative embodiment, a helmet 120 may include one or more compressible balls 200 that are attached to the outer shell 102 of the helmet 120 (and/or to the shock absorbing liner 110, in various embodiments) via multiple flexible strings 300. In the embodiment shown in FIG. 2C, two of the compressible balls 200 of helmet 120 are shown attached to the outer shell 102 by the flexible string 300 (the phantom line showing the compressible ball 200 at a different position within the cavity 114). However, this is just a small section of the helmet 120, shown for illustrative purposes, and any number of the compressible balls 200 in this embodiment may be attached to the outer shell 102, the shock absorbing liner 110, each other, or some combination thereof, by as many flexible strings 300 as desired. In some embodiments, for example, at least some of the compressible balls 200 are attached to one another via any suitable attachment mechanism(s), such as but not limited to flexible string, adhesive, hook-and-loop fasteners (e.g., Velcro), tear-away fabric, magnets, push-buttons, flexible collars or the like. In some embodiments, some of the compressible balls 200 are detached from one another and from the outer shell 102 and the shock absorbing liner 110, and other compressible balls 200 are attached to each other and/or to the outer shell 102 and/or the shock absorbing liner 110 (or the rim of either or both of same).

Figure 2D:
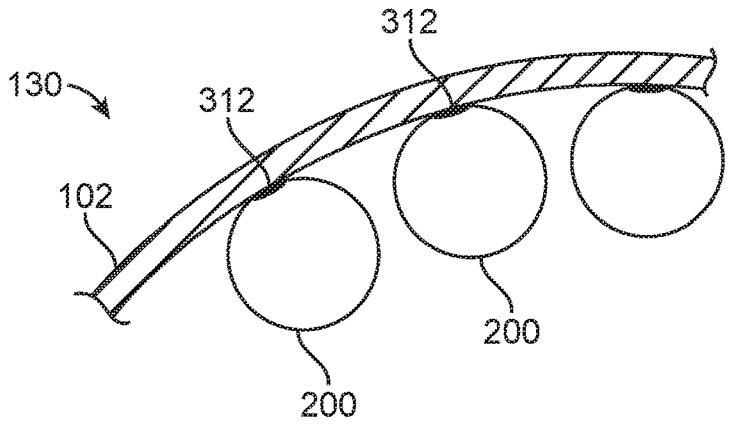
FIG. 2D is a cross-sectional side view of a wall of a shock absorbing helmet, where the balls or spheres are attached to a helmet or helmet-like structure and touch the head directly, according to one embodiment.

Referring now to FIG. 2D, in another embodiment, a helmet 130 may include only one shell, which in this case is labeled as the outer shell 102, but which may also be the shock absorbing liner 110. (Since there is only one shell in this embodiment, the naming of the shell is not limiting.) In this embodiment, multiple compressible balls 200 may be attached to the inner surface of the outer shell 102 via multiple breakable attachment members 312, such as hook-and-loop fasteners or any of the other types of fasteners listed previously. When the helmet 130 is worn, the balls 200 directly contact the wearer's head. Upon impact, some of the balls 200 may detach from the outer shell 102 and roll or move laterally, which may facilitate or enhance shock absorption.

Figure 2E:
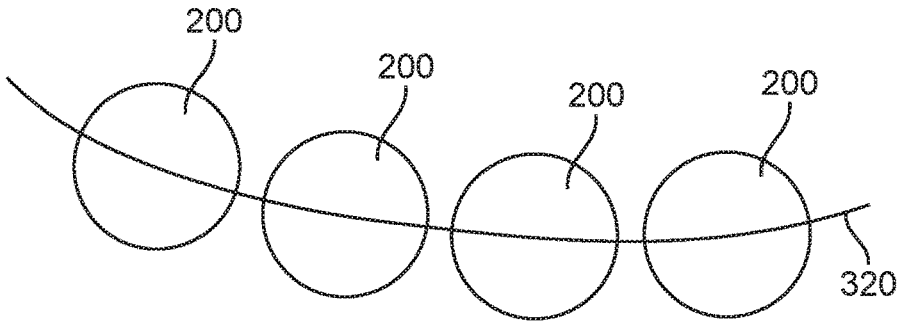
FIG. 2E shows balls or spheres held in place by a string, as may be used in a helmet or other structure, according to one embodiment.
Figure 2F:
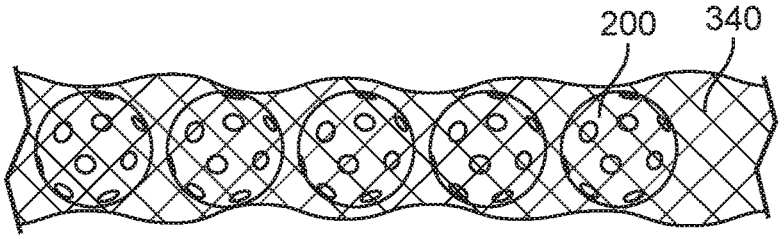
FIG. 2F shows balls or spheres held in place by a tubular net, as may be used in a helmet or other structure, according to one embodiment.

FIG. 2E illustrates one embodiment in which multiple compressible balls 200 are attached to one another by way of a flexible string 320. FIG. 2F shows an alternative embodiment, in which multiple compressible balls 200 are housed within a tubular net 340 or mesh material. Both the string 320 and the net 340 may stretch, flex, loosen, break, tear or the like, in some embodiments. For example, the net 340 may house the compressible balls 200 during normal use, and then tear or stretch upon impact, to allow the compressible balls 200 to roll. The net 340 can be a fabric material, such as a vapor-permeable cloth or mesh that rips and/or stretches upon impact, which then allows the compressible balls 200 to roll.

Again, with reference to FIGS. 2A-2F, according to various embodiments, the helmet 100, 120, 130 includes multiple compressible balls 200, which may: (1) all be separate from one another and "free floating" between the outer shell 102 and the shock absorbing liner 110; (2) attached to one another but not attached to the outer shell 102 or the shock absorbing liner 110; (3) attached to the outer shell 102 and/or the shock absorbing liner 110 but not attached to one another; or (4) include a combination of attached and unattached compressible balls 200. Any suitable combination and configuration is possible, according to various alternative embodiments. Furthermore, the methods of attachment described in relation to FIGS. 2A-2F are merely exemplary and not exhaustive. As described above, for example, the second general category of helmets, which is described further below, has multiple holes in the helmet with the compressible balls 200 located in the holes. Additionally, any of the attachments of the compressible balls 200 to one another and/or of the compressible balls 200 to the outer shell 102 and/or the shock absorbing liner 110 may be configured to be detachable connections, reattachable connections, push-in-and-out collar connections, permanent connections, or combinations thereof, according to various embodiments.

Figure 3A:
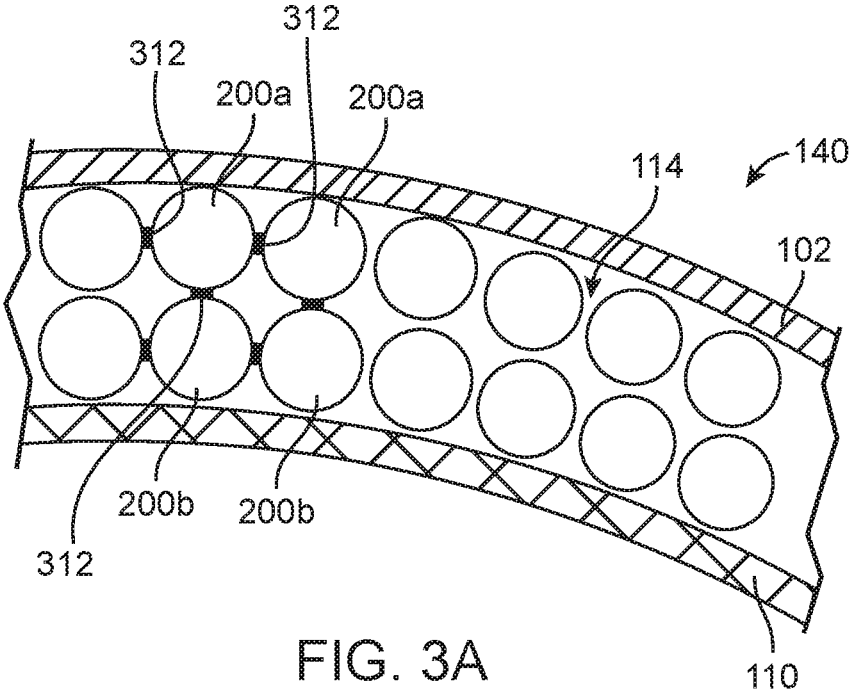
FIG. 3A is a cross-sectional side view of a wall of a shock absorbing helmet with two layers of balls or spheres, according to one embodiment.

Referring now to FIG. 3A, a cross-sectional view of a portion of another alternative embodiment of a shock absorbing helmet 140 is illustrated. In this embodiment, multiple layers of compressible balls 200 are disposed with the cavity 114 between the outer shell 102 and the shock absorbing liner 110 in two layers, stacked on top of each other. An upper layer of compressible balls 200*a* contacts the outer shell 102 but not the shock absorbing liner 110. A lower layer of compressible balls 200*b* contacts the shock absorbing liner 110 but not the outer shell 102. Some or all of the compressible balls 200*a*, 200*b* may be attached to the outer shell 102, the shock absorbing liner 110 and/or to one another via multiple attachment members 312, such as hook-and-loop fasteners (e.g., Velcro), adhesive, magnets or the like. In the embodiment shown in FIG. 3A, the upper and lower layers of compressible balls 200*a*, 200*b* are in direct contact with one another—e.g., the upper group 200*a* is stacked directly on top of the lower group 200*b*. In alternative embodiments, more than two rows of compressible balls 200 may be disposed between the outer shell 102 and the shock absorbing liner 110 (e.g., three rows, four rows, etc.) In some embodiments, the compressible balls 200 in different layers may be free to move/shift from one layer to the other when the helmet 100 is impacted by an object. In some embodiments, the balls 200 may have rough surfaces, which may help absorb impact energy when they roll against each other.

Figure 3B:
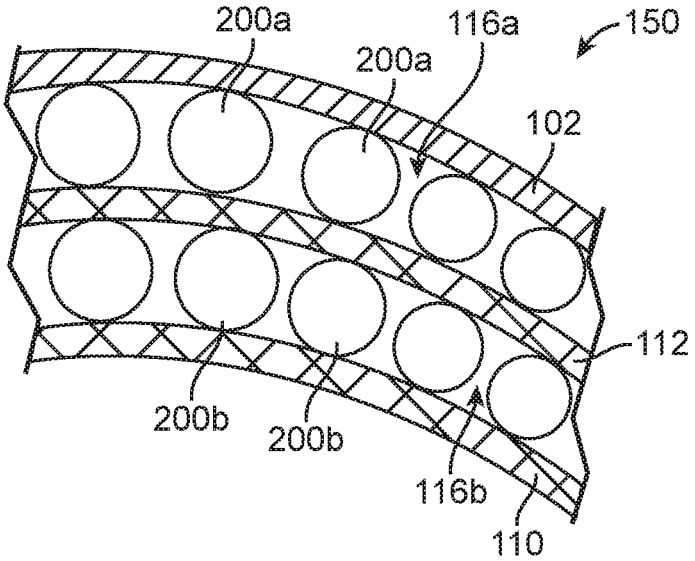
FIG. 3B is a cross-sectional side view of a wall of a shock absorbing helmet with two separated layers of balls or spheres, according to one embodiment.

FIG. 3B is a cross-sectional view of a portion of another alternative embodiment of a shock absorbing helmet 150, in which two groups of compressible balls 200*a*, 200*b* are disposed between the outer shell 102 and the shock absorbing liner 110. In this embodiment, the helmet 100 includes a middle shell 112 between the outer shell 102 and the shock absorbing liner 110, which forms an upper cavity 116*a* and a lower cavity 116*b*. An upper group of the multiple compressible balls 200*a* is disposed in the upper cavity 116*a*, between the outer shell 102 and the middle shell 112. A lower group of the multiple compressible balls 200*b* is disposed in the lower cavity 116*b*, between the lower shell 110 and the middle shell 112. In other embodiments, more than two rows of compressible balls 200 may be disposed between the outer shell 102 and the shock absorbing liner 110 (e.g., three rows, four rows, etc.), and some of these embodiments may include additional middle shells 112 to separate the rows.

Referring to FIGS. 4A-4E, the compressible balls 200, in general, may be made of any suitable material, may have any size, according to the helmet 100 or other device in which they are being used, and may have any suitable shape, configuration and the like. Two very general types of compressible balls 200, for example, are: (1) balls 200 that are hollow inside and include one or more holes or apertures; and (2) balls 200 that have a shell and are filled with a substance, such as a fluid. According to various embodiments, compressible balls 200 may take any suitable form and be made of any suitable material.

Referring again to FIGS. 4A-4E, multiple, alternative embodiments of compressible balls, which may be used in a helmet or other shock absorbing structure, are illustrated. All the illustrated embodiments in these figures include a shell that defines one or more holes, apertures or openings (which terms may be used synonymously herein), for influencing the compressible balls' ability to deform, thus improving the helmet's ability to dampen and disperse direct as well as angular accelerations. The holes are configured to facilitate elastic deformation upon impact, while still providing the compressible balls with sufficient rigidity to roll within a cavity 114, 116*a*, 116*b* of a helmet 100, 120, 130, 140, 150. The holes and the hollowness of the compressible balls 200 also allow the balls 200 to be of low weight and to be washable in some embodiments.

Figure 4D:
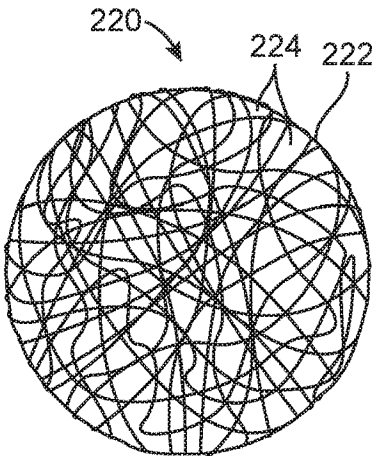
FIGS. 4A-4E show various embodiments of compressible balls or spheres, as may be used in a helmet or other structure, according to one embodiment.
Figure 4C:
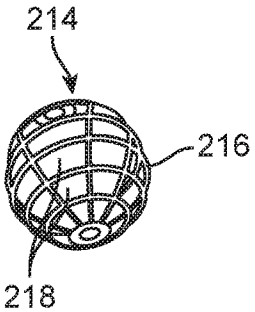
Figure 4B:
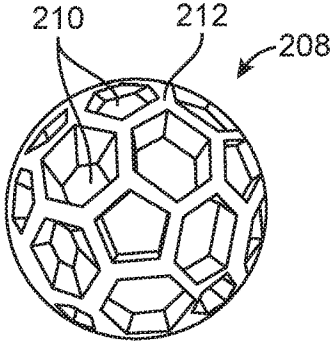
Figure 4A:
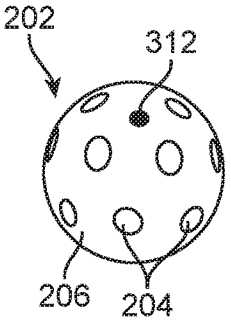

FIG. 4A shows a compressible ball 202 having a shell 206 that defines circular holes 204 that are distributed substantially uniformly about the surface of the shell 206. The holes 204 can extend through the shell 206, from an interior of the shell 206 to an exterior of the shell 206. In some embodiments, the holes 204 are spaced over a majority of the surface of the shell 206. The edges of the holes 204 are preferably smooth or protected by lips, so as to not cause any cuts into the impacting objects. Also illustrated in this embodiment is one attachment member 312, which may be used for attaching the compressible ball 202 to another ball, a shell of a helmet and/or the like, as explained above. In one alternative embodiment (not shown), the holes of the compressible ball may be covered with a material, such as but not limited to a thinner layer of the material used to make the shell. When a compressible ball of that type is impacted, the thinner covering material of the holes (which are no longer actually "holes" in this embodiment, since they are covered) will bulge outward as the ball compresses and absorbs shock.

FIG. 4B shows an alternative embodiment of a compressible ball 208 having a shell 212 that defines hexagonal holes 210 that have different sizes and are distributed substantially uniformly about the surface of the shell 212. FIG. 4C shows another alternative embodiment of a compressible ball 214, which is formed as a shell 216 shaped like a basket and defining multiple holes 218 around the surface of the ball 214. FIG. 4D shows another alternative embodiment of a compressible ball 220, which includes a shell 222 formed as an asymmetrical wire or twisted structure that resembles a ball of string and defines multiple openings or holes 224. This embodiment of the ball 220 could be made of any suitable material, but in one embodiment may be a shape memory metal or plastic.

Figure 4E:
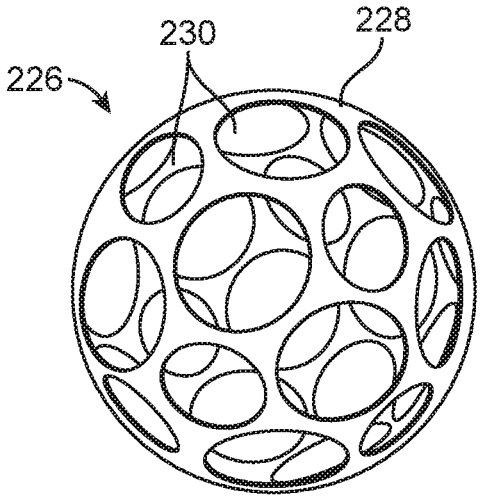

FIG. 4E illustrates another embodiment of a compressible ball 226. Again, this embodiment includes a shell 228 that defines holes 230. In this embodiment, the shell 228 is relatively thin, and the holes 230 are circular and of different sizes.

In alternative embodiments, such as those shown in FIGS. 2A-2E, the compressible balls 200 may be hollow shells without any holes. In these embodiments, the compressible balls 200 will still be compressible and will be made of an elastic or other resilient or shape memory material, so that they can at least partially absorb shock of an impact. These compressible balls may have areas that pop out, burst or spring back to their original form. In some embodiments, the balls 200 may be filled with a liquid or gel material to facilitate absorption of mechanical energy. Some of these embodiments may include one or more holes, pores or weaker sections, which may allow some of the liquid or gel to leak out of the balls 200 when they are compressed.

As shown in the figures, in many embodiments, the compressible balls 200 are spherical. Alternatively, the compressible balls 200 may have an ovoid shape or any other suitable shape, and any combination of sizes and shapes of compressible balls 200 may be used in a given helmet embodiment. In some embodiments, for example, compressible balls 200 in helmets 100 may each have a diameter between about 0.25 inch and about 3 inches, or more specifically between 0.5 inch and about 1 inch. In other embodiments, where the compressible balls 200 are used to shield larger objects, they may have diameters ranging from the one inch to up to 5 feet.

Figure 5:
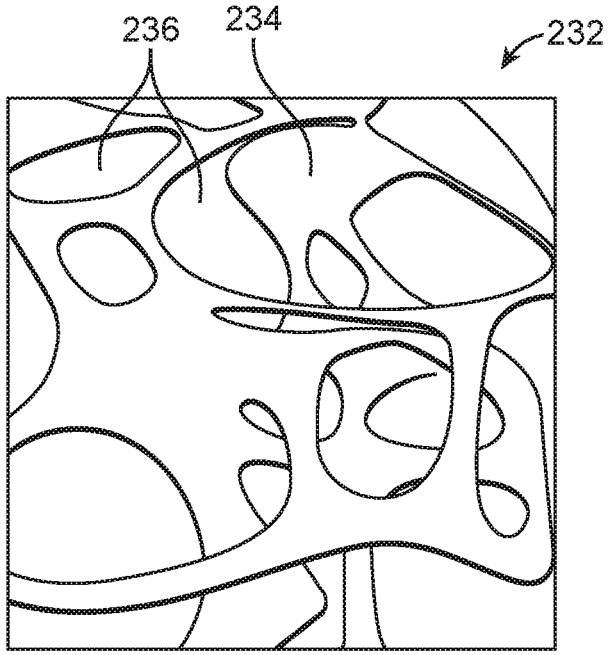
FIG. 5 shows a portion of a lightweight cap or helmet structure, according to one embodiment.

FIG. 5 illustrates a section of an alternative embodiment of shock absorbing cap 232. In this embodiment, the cap 232 includes a shell 234 that defines multiple, irregularly shaped holes 236. The shell 234 is thin and flexible and has multiple, overlapping planes, so that the shell 234 may help to disperse the mechanical energy of an impact. Additionally, any of the embodiments of the compressible balls 200 may be attached to the shell 234 in any of the manners described above for any of the other embodiments. For example, the compressible balls 200 may be located inside and/or outside of the shell 234 and may be attached to any surface of the shell 234 and/or to each other. In some embodiments, balls 200 may be located in some or all of the holes, and they may protrude into and out of the cap 232. The cap 232 may be lightweight and very flexible, and it may be used in a number of different settings, such as to demonstrate the efficacy of other shock absorbing helmets described herein, for fashion models, or for any endeavors in which some amount of protection might be desired, without the need for a more substantial helmet.

Figure 6A:
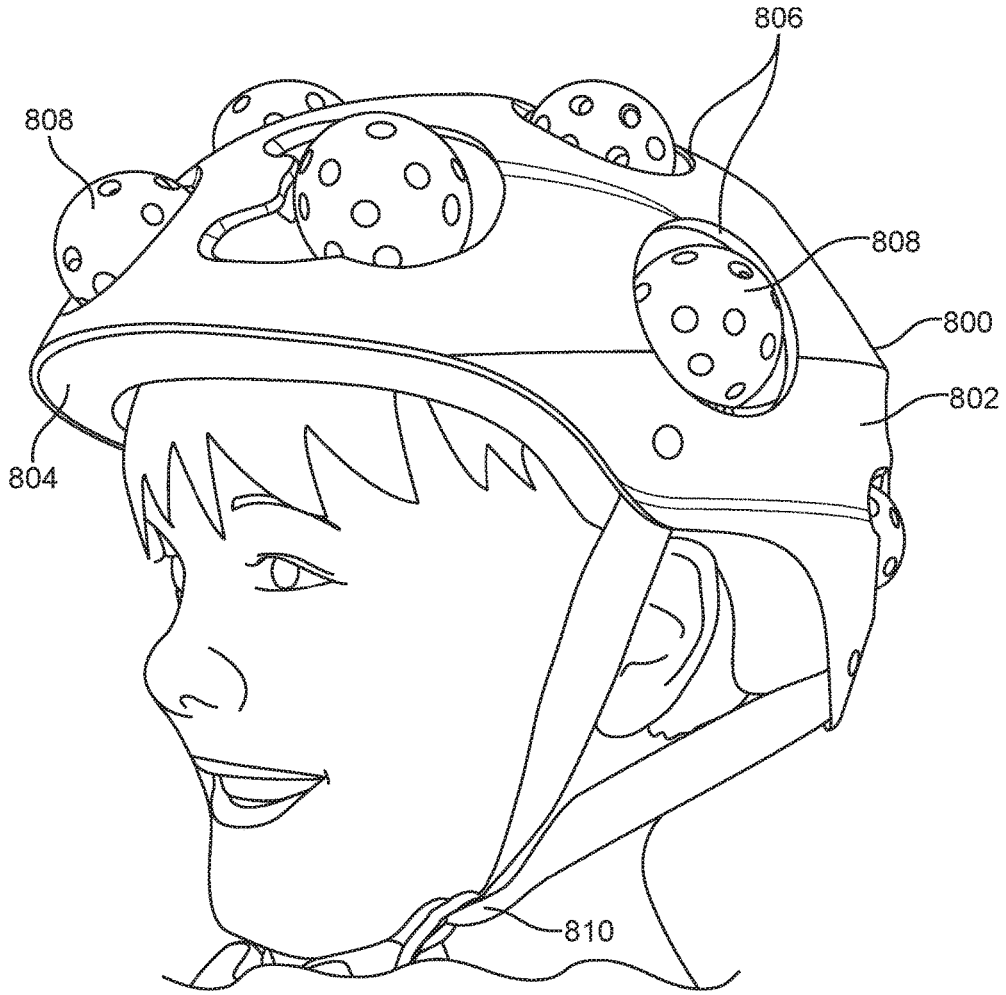
FIG. 6A shows a perspective view of a shock absorbing helmet, according to an alternative embodiment.
Figure 6B:
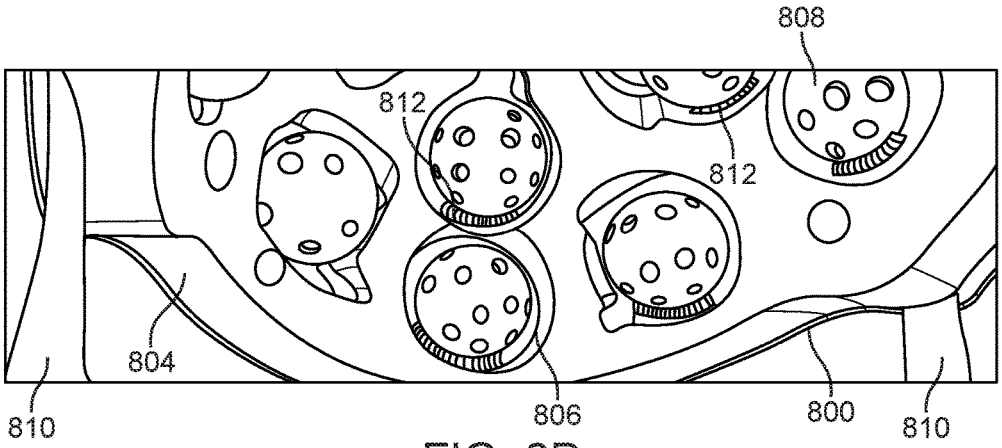
FIG. 6B shows an underside view of the helmet of FIG. 6A.
Figure 6C:
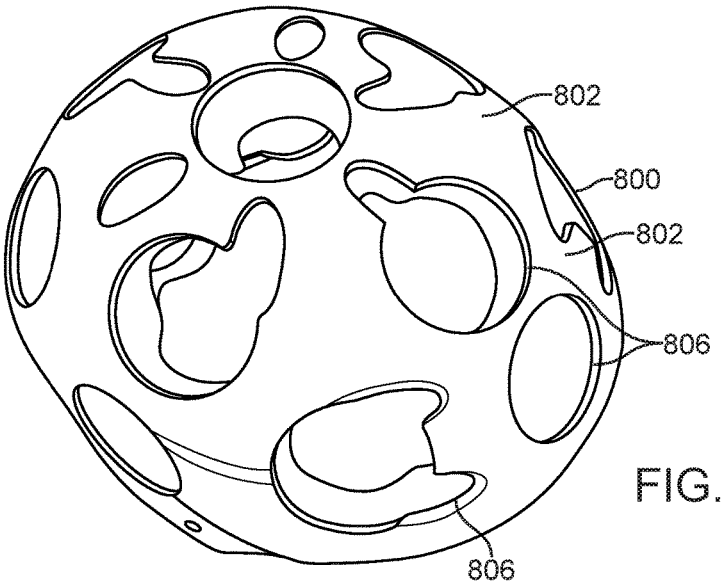
FIG. 6C shows a top perspective view of the helmet of FIGS. 6A and 6B, with the compressible balls of the helmet removed.

Referring now to FIGS. 6A-6C, another alternative embodiment of a shock absorbing helmet 800 may be of the type referred to above as the second general category of helmets—e.g., where compressible balls 808 are attached to the helmet 800 in such a way as to protrude through holes 806 (or "openings" or "apertures") in the helmet 800. In this embodiment, the helmet 800 includes an outer shell 802, for example made of hardened plastic or the like, an inner shock absorbing liner 804, which may be made of a padding material, and a chin strap 810. The outer shell 802 and the inner shock absorbing liner 804 are attached together to form the frame of the helmet 800, and they include multiple holes 806, which may be circular or have any other suitable shape. One of the compressible balls 808 is housed in each of the holes 806 in the helmet 800. In this embodiment, for example, the balls 808 are attached to the sides of the helmet 800 that form the holes via Velcro attachment members 812 (only visible in FIG. 6B). This is only one example, however, and any of the attachment devices described in this application may be used. Upon impact, one or more of the balls 808 may be knocked free from their attachments to the helmet 800, and this, as well as the compressible nature of the balls 808, may help absorb shock from impacts coming from any direction.

As best seen in FIG. 6C, the holes 806 may have different, asymmetrical shapes in some embodiments. Alternatively, they may all be round. As seen best in FIGS. 6A and 6B, the compressible balls 808 protrude through both sides of the helmet 800, so that they contact the wearer's head and also protrude outward through the outer shell 802. In many cases, one or more of the balls 808 will be the first portion of the helmet 800 that comes into contact with a structure that impacts the helmet 800. As described previously, one or more of the balls 808 may break free from the helmet 800 upon impact. In many embodiments, any balls 808 that break free may be replaced for further wear/use of the helmet 800. In other embodiments (not shown), compressible balls may protrude through only one layer of the helmet—i.e., in only one direction, inward or outward—and the holes may not extend through both layers. Any combination and configuration of balls protruding through one or more layers of a helmet may be used, according to various embodiments.

Figure 7A:
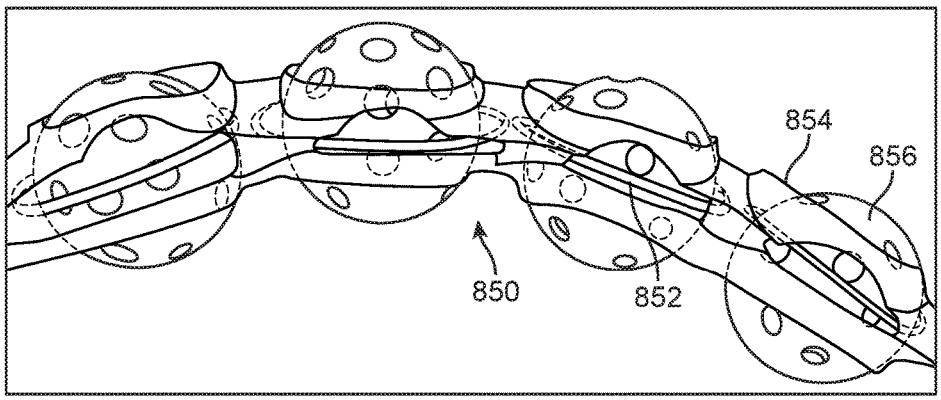
FIG. 7A shows a perspective view of a structure of connected compressible balls, which may be used in some helmet embodiments.
Figure 7B:
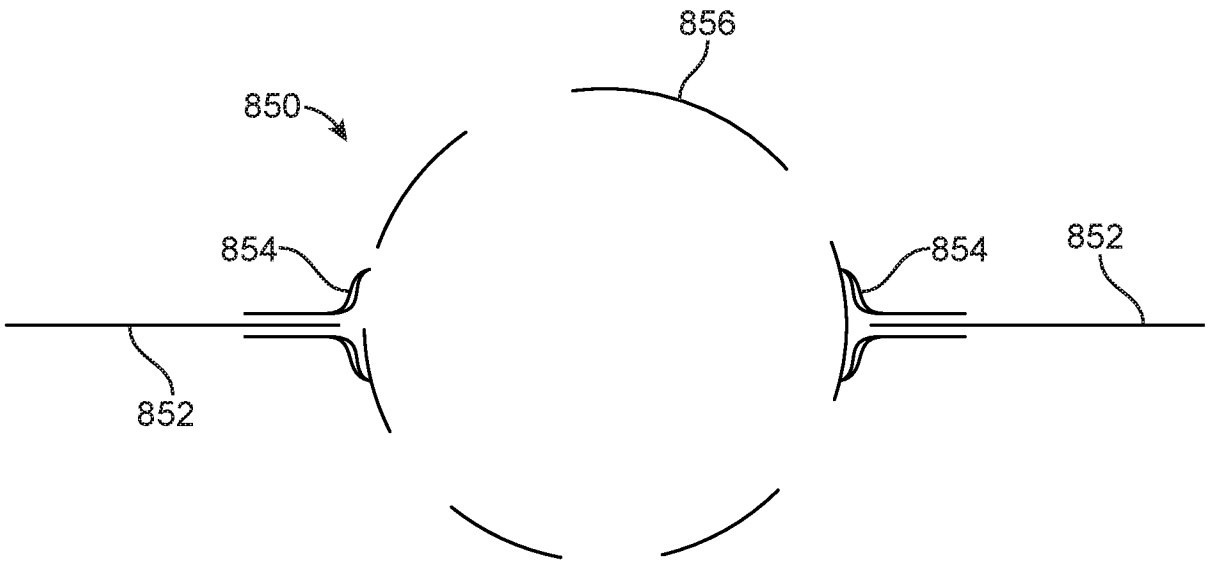
FIG. 7B shows a cross-sectional view of a portion of the structure of FIG. 7A.

With reference now to FIGS. 7A and 7B, a compressible ball connecting fixture 850 is illustrated. The illustrated structure is not a complete helmet but simply illustrates one embodiment of a structure for connecting multiple compressible balls 856 to a framework. The connecting fixture 850 may be used in a helmet or for other shock absorbing devices. In this embodiment, the fixture 850 includes a frame 852 and pop-in/pop-out sleeves 854 attached to the frame 852. Multiple compressible balls 856 are disposed within the holes formed by the frame 852 and the sleeves 854. The frame 852 and the sleeves 854 may be made of any material or combination of materials, such as any suitable plastic or metal. The sleeves 854 are sized so that the balls 856 pop into and out of the sleeves 854 but will generally remain in place within the sleeves 854 unless and until the fixture 850 (or the helmet of which it is a part) is impacted. Upon impact, one or more of the balls 856 may pop out of one or more of the sleeves 854 and may thus help absorb shock to the head from the impact. In some embodiments, the balls 856 may include one or more small protrusions, which help hold the balls 856 in the sleeves 854. In other embodiments, the protrusions are not necessary. In some embodiments, the sleeves 854 may be formed as one continuous piece, while in alternative embodiments they may be separate pieces.

Figure 8:
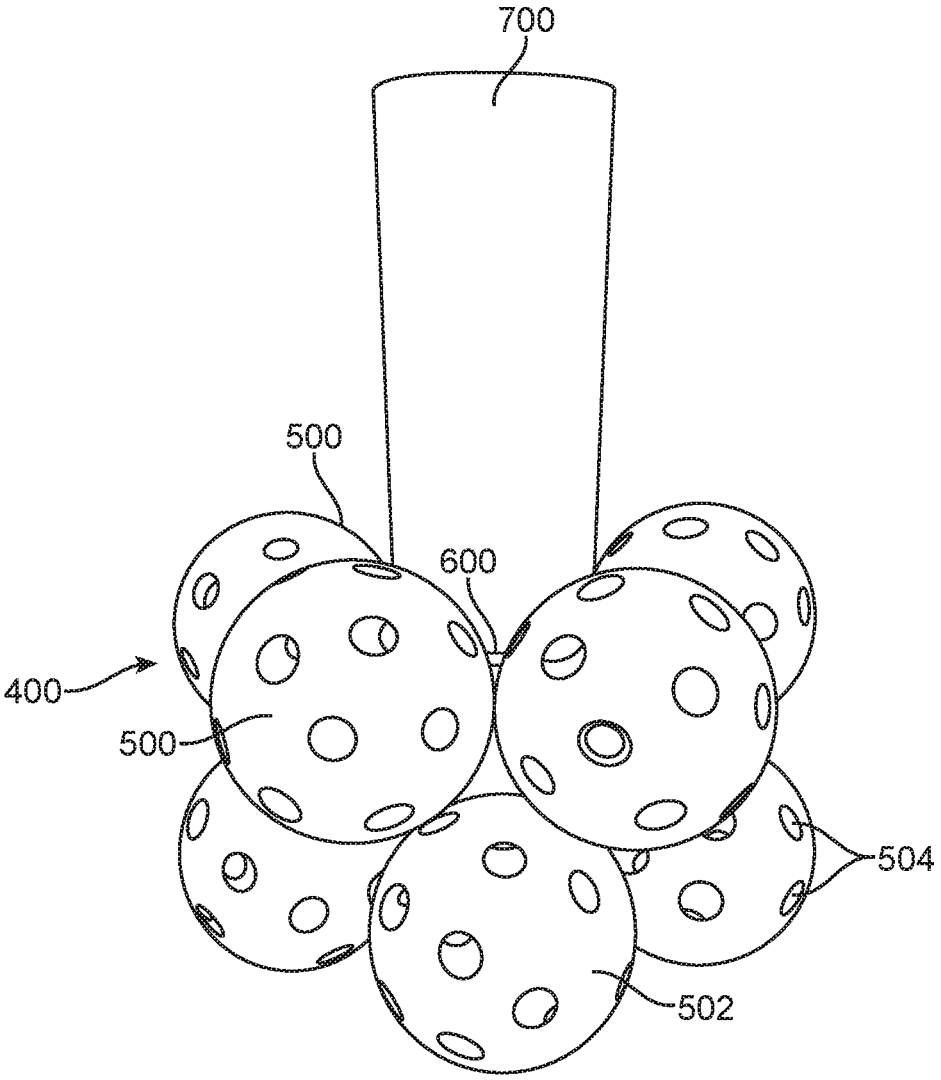
FIG. 8 is a perspective view of a shock absorbing structural padding system, according to one embodiment.

Referring now to FIG. 8, one embodiment of a structural padding system 400 is illustrated. The system 400 includes multiple compressible balls 500 and one or more attachment members 600, such as a rigid or flexible string, adhesive, or hook-and-loop fasteners (e.g., Velcro). The attachment member(s) are used to attach the balls 500 to a structure 700, such as a goal post, road sign post, lamp post or the like, to help dampen any impact from a collision of a person or object with the structure 700. In this embodiment, the attachment member 600 is a string, but in alternative embodiments, the attachment member 600 may be mesh fabric, solid fabric, plastic, leather, any type of flexible membrane, a solid thin structure, or the like. The padding system 400 may be attached to a sports structure 700, such as a pole, a goalpost, a goalie net, a piece of athletic training equipment, law enforcement or military shield, roadside poles, roadside signs, roadside rails, construction equipment, construction materials, corners, snow machines, trees or the like. The compressible balls 500 are configured to roll upon impact, for example, upon impact by an athlete, runner, performer, animal, vehicle or other moving entity. Each of the compressible balls 500 has a shell 502 that defines one or more holes 504 extending from an interior of the shell 502 to an exterior of the shell to facilitate elastic deformation of the shell 502 upon impact.

In some embodiments, the compressible balls 500 may be covered with a covering (not shown), such as a fabric, leather, plastic or the like. The covering may also act as a holder for the compressible balls 500. For example, in various embodiments the cover may be a meshwork fabric, a flexible membrane, a hard material, a plastic, a solid fabric, an elastic material or a shape memory material. This may be similar, in one embodiment for example, to the embodiment illustrate in FIG. 2F.

The foregoing description has broad application. For example, while examples disclosed herein may focus on helmet and structures, the concepts disclosed herein may equally apply to substantially any other devices (e.g., shin guards, knee guards, elbow guards, etc., post on an athletic field, roadside poles, roadside signs and rails, construction equipment, stacked materials, snow machines, lift and electric poles permanently parked or slow moving vehicles, corners, trees, fixed or temporary structures, shields or the like. Accordingly, the discussion of any embodiment is meant only to be exemplary and is not intended to suggest that the scope of the disclosure, including the claims, is limited to these examples.

I claim:

1. A shock absorbing helmet, comprising:

an outer shell having multiple outer shell holes;

an inner shock absorbing liner attached to the outer shell and having multiple inner liner holes; and multiple compressible balls disposed between the outer shell and the shock absorbing liner in such a way that the compressible balls are free to move, relative to the outer shell and the inner shock absorbing liner, when the helmet is impacted by an object, wherein each of the multiple compressible balls protrudes through one of the outer shell holes and one of the inner liner holes, such that it is free to rotate when the helmet is impacted.

2. The shock absorbing helmet of claim 1, wherein each of the compressible balls is hollow.

3. The shock absorbing helmet of claim 1, wherein each of the compressible balls comprises multiple holes, and wherein each of the multiple holes has a shape selected from the group consisting of circular, oval and hexagonal.

4. The shock absorbing helmet of claim 1, wherein the compressible balls are made of a material selected from the group consisting of elastic materials, resilient materials and shape memory materials.

5. The shock absorbing helmet of claim 4, wherein multiple holes in each of the compressible balls are covered by the material, and wherein the material covering the holes is thinner than the material forming the non-hole portion of the ball.

6. The shock absorbing helmet of claim 1, wherein each of the compressible balls is filled with a substance selected from the group consisting of a liquid, a gel and a foam.

7. The shock absorbing helmet of claim 1, further comprising at least one attachment member for attaching at least one of the multiple compressible balls to at least one of the shock absorbing liner, the outer shell or a neighboring one of the multiple compressible balls.

8. The shock absorbing helmet of claim 7, wherein the at least one attachment member is selected from the group consisting of flexible string, hook-and-loop fasteners, stretchable material, tear-away material, magnets, push-buttons, flexible collars and detachable adhesive.

9. The shock absorbing helmet of claim 1, further comprising multiple attachment members for attaching the multiple compressible balls to at least one of the outer shell or the shock absorbing liner, to maintain the compressible balls in their locations within the multiple outer shell holes and the multiple inner liner holes.

10. The shock absorbing helmet of claim 9, wherein the multiple attachment members are breakable and are selected from the group consisting of hook-and-loop fasteners, magnets, push-buttons, flexible collars, pop-in/pop-out sleeves and detachable adhesive.

11. The shock absorbing helmet of claim 9, wherein the multiple attachment members comprise:

a frame with multiple holes; and multiple pop-in/pop-out sleeves attached to the frame around the multiple holes.

12. A method of manufacturing a shock absorbing helmet, the method comprising:

forming an outer shell of the helmet with multiple outer shell holes;

forming a shock absorbing liner of the helmet with multiple liner holes;

positioning multiple compressible balls between the outer shell and the shock absorbing liner in such a way that each of the compressible balls protrudes through one of the multiple outer shell holes and one of the multiple liner holes so that each of the compressible balls is free to rotate, relative to the outer shell and the shock absorbing liner, when the helmet is impacted by an object; and attaching the outer shell to the shock absorbing liner.

13. The method of claim 12, wherein the outer shell and the shock absorbing liner form a cavity between them when they are attached to one another, and wherein the multiple compressible balls are positioned in the cavity.

14. The method of claim 13, wherein the compressible balls are placed between the outer shell and the shock absorbing liner before the outer shell and the shock absorbing liner are attached to one another to form the cavity.

15. The method of claim 12, wherein each of the compressible balls is hollow.

16. The method of claim 12, wherein each of the compressible balls comprises multiple holes.

17. The method of claim 12, wherein the compressible balls are made of a material selected from the group consisting of elastic materials, resilient materials and shape memory materials.

18. The method of claim 12, wherein each of the compressible balls is filled with a substance selected from the group consisting of liquids, gels and foams.

19. The method of claim 12, further comprising attaching the compressible balls to at least one of the outer shell or the shock absorbing liner using at least one attachment member selected from the group consisting of flexible string, hook-and-loop fasteners, stretchable material, tear-away material, magnets, push-buttons, flexible collars and adhesive.

20. The method of claim 12, further comprising attaching at least some of the compressible balls to one another using at least one attachment member selected from the group consisting of flexible string, hook-and-loop fasteners, stretchable material, tear-away material, magnets, push-buttons, flexible collars and adhesive.

21. A shock absorbing helmet, comprising:

an outer shell;

an inner shock absorbing liner attached to the outer shell to form a cavity; and multiple compressible balls disposed in the cavity such that they are free to roll within the cavity when the helmet is impacted by an object, wherein the multiple compressible balls comprise:

an upper layer of compressible balls that contact the outer shell; and a lower layer of compressible balls that contact the shock absorbing liner, wherein at least some of the compressible balls are free to move from the upper layer to the lower layer or from the lower layer to the upper layer upon impact of the helmet with the object.

22. A shock absorbing helmet, comprising:

an outer shell;

an inner shock absorbing liner attached to the outer shell to form a cavity;

a middle shell disposed between the outer shell and the shock absorbing liner; and multiple compressible balls disposed in the cavity such that they are free to roll within the cavity when the helmet is impacted by an object, wherein the multiple compressible balls comprise:

an upper layer of compressible balls disposed between the outer shell and the middle shell; and a lower layer of compressible balls disposed between the middle shell and the shock absorbing liner.

23. A shock absorbing helmet, comprising:

an outer shell;

an inner shock absorbing liner attached to the outer shell; and multiple compressible balls coupled with at least one of the outer shell or the inner shock absorbing liner in such a way that the compressible balls are free to move, relative to the outer shell and the inner shock absorbing liner, when the helmet is impacted by an object, wherein the compressible balls are made of a material selected from the group consisting of elastic materials, resilient materials and shape memory materials, wherein multiple holes in each of the compressible balls are covered by the material, and wherein the material covering the holes is thinner than the material forming the non-hole portion of the each of the balls.

24. A method of manufacturing a shock absorbing helmet, the method comprising:

forming an outer shell of the helmet;

attaching a shock absorbing liner to the outer shell to form a cavity;

placing multiple compressible balls in the cavity, such that the compressible balls are free to roll within the cavity when the outer shell of the helmet is impacted by an object, wherein placing the compressible balls comprises stacking an upper layer of the compressible balls over a lower layer of the compressible balls within the cavity, and wherein the compressible balls are placed between the outer shell and the shock absorbing liner before the outer shell and the shock absorbing liner are attached to one another to form the cavity; and positioning a middle shell between the upper layer and the lower layer of the compressible balls.

* * * * *